US006692541B2

(12) United States Patent
Carlson et al.

(10) Patent No.: US 6,692,541 B2
(45) Date of Patent: Feb. 17, 2004

(54) METHOD OF MAKING NONWOVEN FABRIC COMPRISING SPLITTABLE FIBERS

(75) Inventors: Cheryl Carlson, Willow Springs, NC (US); John Elves, Venray (NL); Kyra Dorsey, Charlotte, NC (US); Ralph A. Moody, III, Mooresville, NC (US); Valeria Erdos, Huntersville, NC (US)

(73) Assignee: Polymer Group, Inc., North Charleston, SC (US)

( * ) Notice: Subject to any disclaimer, the term of this patent is extended or adjusted under 35 U.S.C. 154(b) by 229 days.

(21) Appl. No.: 09/859,049

(22) Filed: May 16, 2001

(65) Prior Publication Data

US 2002/0028623 A1 Mar. 7, 2002

Related U.S. Application Data

(60) Provisional application No. 60/204,721, filed on May 16, 2000.

(51) Int. Cl.[7] ..... D06P 5/00; D06P 3/82

(52) U.S. Cl. ..... 8/499; 8/529; 8/531; 28/104; 28/105; 28/106; 28/109; 68/177; 428/401

(58) Field of Search ..... 28/104, 105, 106, 28/109; 8/529, 531, 499; 68/177; 428/401

(56) References Cited

U.S. PATENT DOCUMENTS

| | | | | |
|---|---|---|---|---|
| 2,862,251 | A | | 12/1958 | Kalwaites |
| 3,485,707 | A | | 12/1969 | Evans |
| 3,692,618 | A | | 9/1972 | Dorschner et al. |
| 4,107,374 | A | | 8/1978 | Kusunose et al. |
| 4,476,186 | A | | 10/1984 | Kato et al. |
| 4,560,385 | A | | 12/1985 | Baravian |
| 4,668,566 | A | | 5/1987 | Braun |
| 4,774,110 | A | | 9/1988 | Murakami et al. |
| 4,997,611 | A | | 3/1991 | Hartmann |
| 5,098,764 | A | | 3/1992 | Drelich et al. |
| 5,142,750 | A | | 9/1992 | Dyer et al. |
| 5,142,753 | A | | 9/1992 | Bolliand et al. |
| 5,244,711 | A | | 9/1993 | Drelich et al. |
| 5,290,626 | A | | 3/1994 | Nishioi et al. |
| 5,355,565 | A | | 10/1994 | Baravian |
| 5,482,772 | A | | 1/1996 | Strack et al. |
| 5,635,290 | A | | 6/1997 | Stopper et al. |
| 5,670,234 | A | | 9/1997 | Suehr et al. |
| 5,827,597 | A | | 10/1998 | James et al. |
| 5,840,633 | A | | 11/1998 | Kurihara et al. |
| 5,888,916 | A | | 3/1999 | Tadokoro et al. |
| 5,894,747 | A | * | 4/1999 | Abernathy et al. |
| 5,899,785 | A | | 5/1999 | Groten et al. |
| 5,965,084 | A | | 10/1999 | Nishijima |
| 5,970,583 | A | | 10/1999 | Groten et al. |
| 6,103,061 | A | | 8/2000 | Anderson et al. |
| 6,200,669 | B1 | * | 3/2001 | Marmon et al. |
| 6,228,490 | B1 | * | 5/2001 | Nagano et al. |
| 6,444,312 | B1 | * | 9/2002 | Dugan |
| 6,461,729 | B1 | * | 10/2002 | Dugan |
| 2002/0187329 | A1 | | 12/2002 | Ista et al. |

OTHER PUBLICATIONS

"Advanced Fiber Spinning Technology", edited by Professor T. Nakajima, Japanese Edition first published 1992, pp. 104–128, pp. 186–206, pp. 224–252.

* cited by examiner

*Primary Examiner*—Margaret Einsmann
(74) *Attorney, Agent, or Firm*—Wood, Phillips, Katz, Clark & Mortimer

(57) ABSTRACT

The present invention relates generally to a method of making nonwoven fabrics, wherein the fabrics are formed from splittable filaments or staple length fibers having a plurality of sub-components which are at least partially separable. The filaments or fibers are at least partially separated into their sub-components attendant to hydroentanglement, which can be effected on a three-dimensional image transfer device. Improved physical properties, including improved tensile strength, elongation, and Taber Abrasion resistance are achieved.

6 Claims, 10 Drawing Sheets

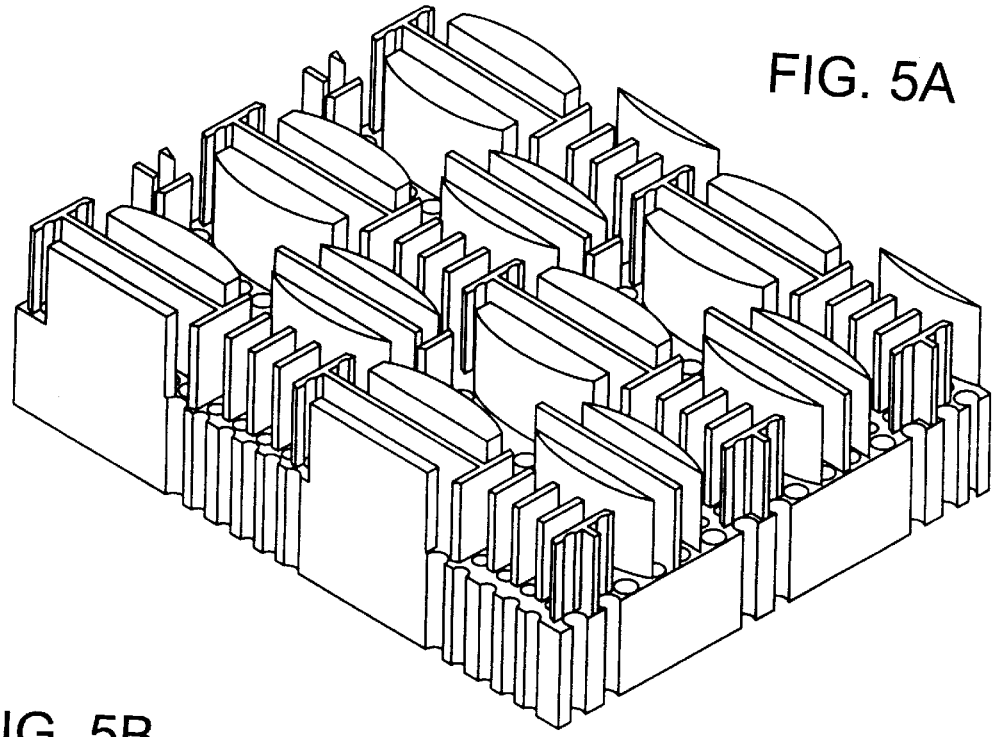
FIG. 5A
FIG. 5B
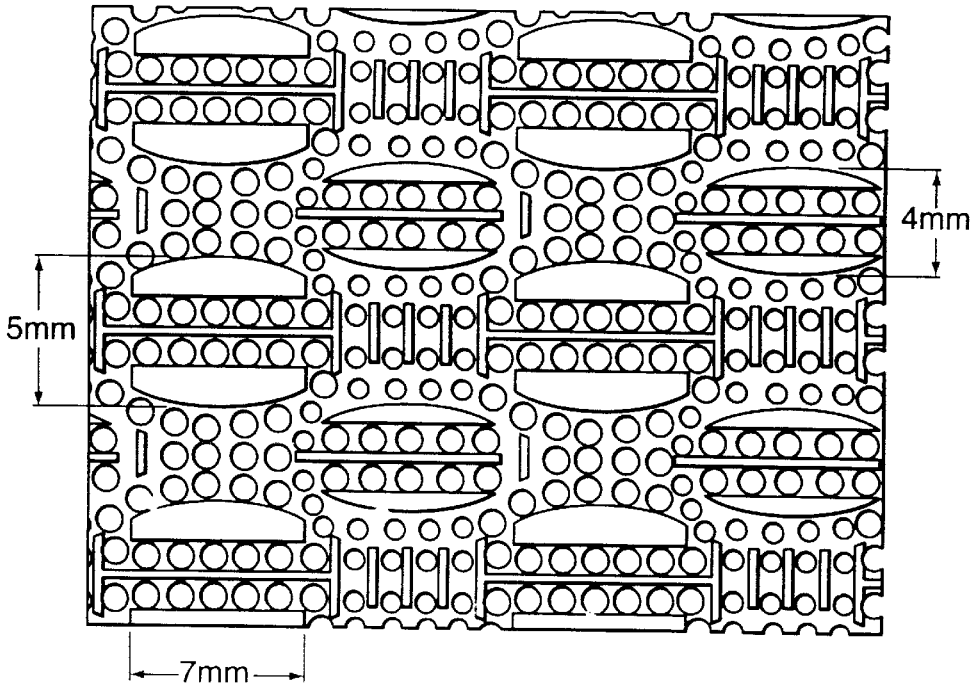

Image Transfer Device: "Enlarged Basketweave"

ITD Depth: 0.13" Element Depth 0.05"

Photograph of lace fabric formed on lace ITD

Top light

Control sample: CLC-205-NF Sample: CLC-069B-NF top1

Darkfield light

Control sample: CLC-205-NF Sample: CLC-069B-NF dkfield1

Top light

Control sample: CLC-205-NF Sample: CLC-096A-NF top2

Darkfield light

Control sample: CLC-205-NF Sample: CLC-096A-NF dkfield2

Top light

Darkfield light

SECT. A - A

SECT. B - B

METHOD OF MAKING NONWOVEN FABRIC COMPRISING SPLITTABLE FIBERS

TECHNICAL FIELD

The present invention relates generally to a method of making a nonwoven fabric exhibiting enhanced physical properties, including improved drape and hand, and more particularly to a method of making a nonwoven fabric comprising hydroentangling a precursor web at least partially comprising splittable filaments or staple length fibers, whereby the precursor web is imaged and patterned on a three-dimensional image transfer device.

BACKGROUND OF THE INVENTION

Nonwoven fabrics are used in a wide variety of applications where the engineered qualities of the fabric can be advantageously employed. These types of fabrics differ from traditional woven or knitted fabrics in that the fabrics are produced directly from a fibrous mat eliminating the traditional textile manufacturing processes of multi-step yarn preparation, and weaving or knitting. Entanglement of the fibers or filaments of the fabric acts to provide the fabric with a substantial level of integrity.

U.S. Pat. No. 3,485,706, to Evans, hereby incorporated by reference, discloses processes for effecting the hydroentanglement of nonwoven fabrics. More recently, hydroentanglement techniques have been developed which impart images or patterns to the entangled fabric by effecting hydroentanglement on three-dimensional image transfer devices. Such three-dimensional image transfer devices are disclosed in U.S. Pat. Nos. 5,098,764, and 5,244,711, hereby incorporated by reference, with the use of such image transfer devices being desirable for providing fabrics with the desired physical properties as well as an aesthetically pleasing appearance.

For specific applications, a nonwoven fabric must exhibit a combination of specific physical characteristics. For example, for some applications it is desirable that nonwoven fabrics exhibit both wet and dry strength characteristics comparable to those of traditional woven or knitted fabrics. While nonwoven fabrics exhibiting sufficient strength can typically be manufactured by selection of appropriate fiber or filament composition, fabric basis weight, and specific process parameters, the resultant fabrics may not exhibit the desired degree of drapeability and hand as traditional woven or knitted fabrics exhibiting comparable strength. While it is known in the prior art to treat nonwoven fabrics with binder compositions for enhancing their strength and durability, such treatment can undesirably detract from the drape and hand of the fabric.

While manufacture of nonwoven fabrics from homopolymer, single component filaments or fibers is well-known, use of multi-component "splittable" fibers or filaments can be advantageous for some applications. These types of splittable fibers or filaments comprise plural sub-components, typically comprising two or more different polymeric materials, with the sub-components arranged in side-by-side relationship along the length of the filaments or fibers. Various specific cross-sectional configurations are known, such as segmented-pie sub-components, islands-in-the-sea sub-components, flower-like sub-components, side-by-side sub-component arrays, as well as a variety of additional specific configurations.

The sub-components of splittable fibers or filaments can be separated by various chemical or mechanical processing techniques. For example, portions of the multi-component fiber or filament can be separated by heating, needlepunching, or water jet treatment. Suitable chemical treatment of some types of multi-component fibers or filaments acts to dissolve portions thereof, thus at least partially separating the sub-components of the fibers or filaments.

U.S. Pat. No. 4,476,186, to Kato et al., hereby incorporated by reference, discloses various forms of multi-component fibers and filaments, and contemplates formation of structures wherein splitting of the fibers or filaments on one or more surfaces of these structures provides desired physical properties. This patent particularly contemplates treatment of the fibrous structures with polyurethane compositions, to thereby form synthetic leather-like materials.

The present invention contemplates formation of nonwoven fabrics exhibiting desired physical properties, including wet and dry strength characteristics, as well as good drapeability and hand.

SUMMARY OF THE INVENTION

The present invention is directed to a method of making a nonwoven fabric which includes imaging and patterning of a precursor web by hydroentanglement on a three-dimensional image transfer device. Notably, the precursor web at least partially comprises splittable filaments or staple length fibers, each of which comprises plural sub-components which are at least partially separable from each other. Attendant to hydroentanglement, the high pressure liquid streams impinging upon the precursor web act to at least partially separate the sub-components of the splittable filaments or fibers from each other, thus creating filament or fiber components having relatively small deniers. Because of the relatively reduced bending modules exhibited by the fine-denier sub-components, imaging and entanglement of the web is enhanced for fabric formation. The resultant fabric exhibits relatively high wet and dry tensile strengths, without resort to application of binder compositions or the like, and thus exhibits desirable drapeability and hand. By virtue of the fabric's integrity, post-formation processes, such as jet dyeing, can be effected without the application of a binder composition, as is typically required.

In accordance with the disclosed embodiment, the present method comprises providing a precursor web at least partially comprising splittable, staple length fibers, wherein each of the splittable fibers comprises plural sub-components at least partially separable from each other. In presently preferred embodiments, splittable fibers having so-called segmented-pie and swirled configurations have been employed.

The present method further comprises providing a three-dimensional image transfer device having a foraminous forming surface. This type of image transfer device includes a distinct surface pattern or image which is imparted to the precursor web during fabric formation by hydroentanglement.

The precursor web is positioned on the image transfer device, with hydroentanglement effected by application of a plurality of high-pressure liquid streams. The high-pressure liquid streams act to entangle and integrate the fibers of the precursor web. By virtue of their high energy, the liquid streams at least partially separate the sub-components of the splittable fibers, thus enhancing the clarity of the image imparted to the precursor web from the image transfer device.

Depending upon the specific application for the resultant nonwoven fabric, various types of splittable, staple length fibers can be employed. In current embodiments, splittable staple length fibers have been used comprising nylon, and one of 1,4 cyclohexamethyl terephthalate and polyethylene terephthalate sub-components. It is also contemplated that the splittable fibers may be blended with staple length fibers selected from the group consisting of nylon, polyester and rayon.

Cross-lapping of a carded precursor web prior to positioning on the image transfer device desirably enhances the effect of the hydroentanglement treatment in patterning and imaging the precursor web. By virtue of the high degree of integrity imparted to the web attendant to hydroentanglement, the present method further contemplates that the nonwoven fabric can be jet dyed, subsequent to hydroentanglement, preferably without the application of a binder composition thereto.

A nonwoven fabric embodying the principles of the present invention can be formed to exhibit low air permeability, with the fabric thus being suitable for applications where the barrier properties of a fabric are important, such as for medical gowns and the like. The fabric is formed from a fibrous matrix at least partially comprising splittable, spunbond filaments, wherein each of the splittable filaments comprises plural sub-components at least partially separated from each other. Notably, the fabric has been found to exhibit desirably high strength and elongation, exhibiting permeability lower than a comparable melt blown fabric, while being three to four times stronger, with three to five times more elongation. Aside from medical applications, potential uses include filter media and personal hygiene articles.

Other features and advantages of the present invention will become readily apparent from the following detailed description, the accompanying drawings, and the appended claims.

BRIEF DESCRIPTION OF THE DRAWINGS

FIGS. 5A and 5B are isometric and plan views, respectively, of the configuration of a "pique" three-dimensional image transfer device;

DETAILED DESCRIPTION

Figure 1:
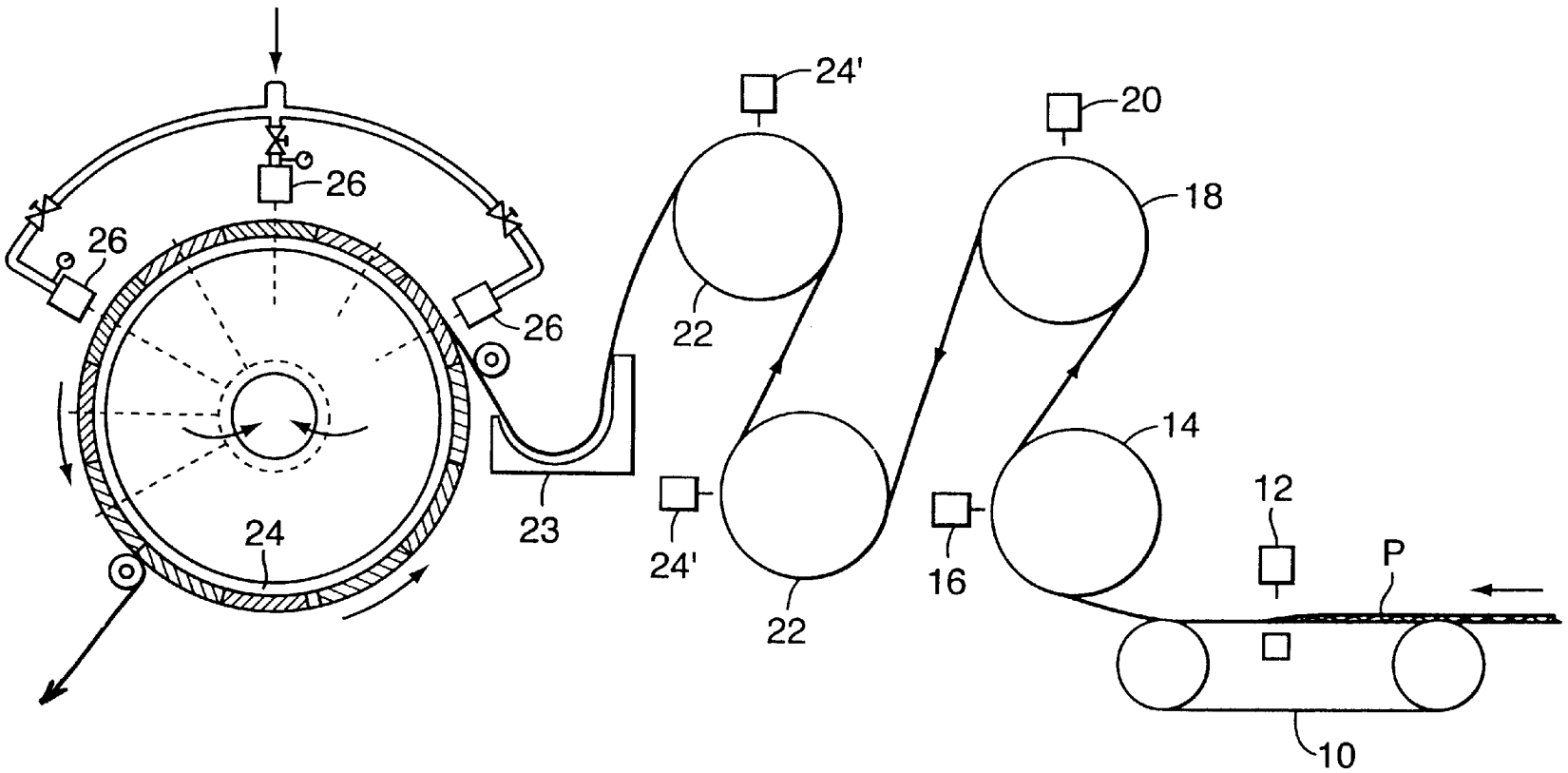
FIG. 1 is a diagrammatic view of a hydroentangling apparatus for practicing the method of the present invention.
Figure 2:
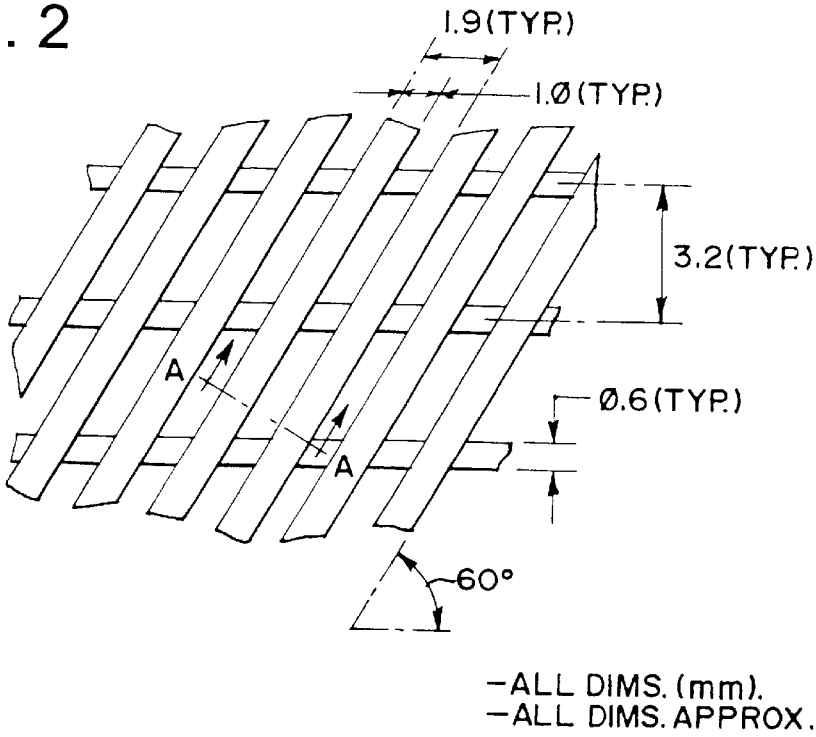
FIGS. 2–4 are views illustrating the configuration of a "left-hand twill" three-dimensional image transfer device.
Figure 3:
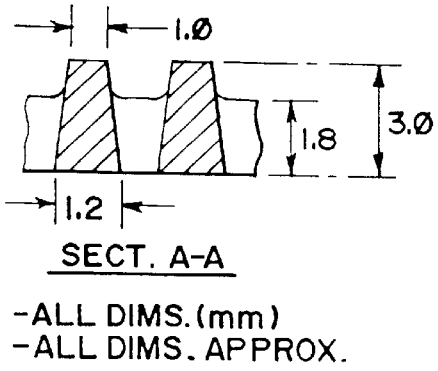
Figure 4:
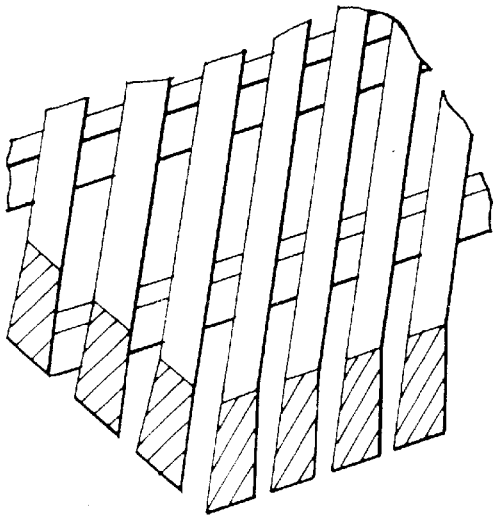
Figure 6:
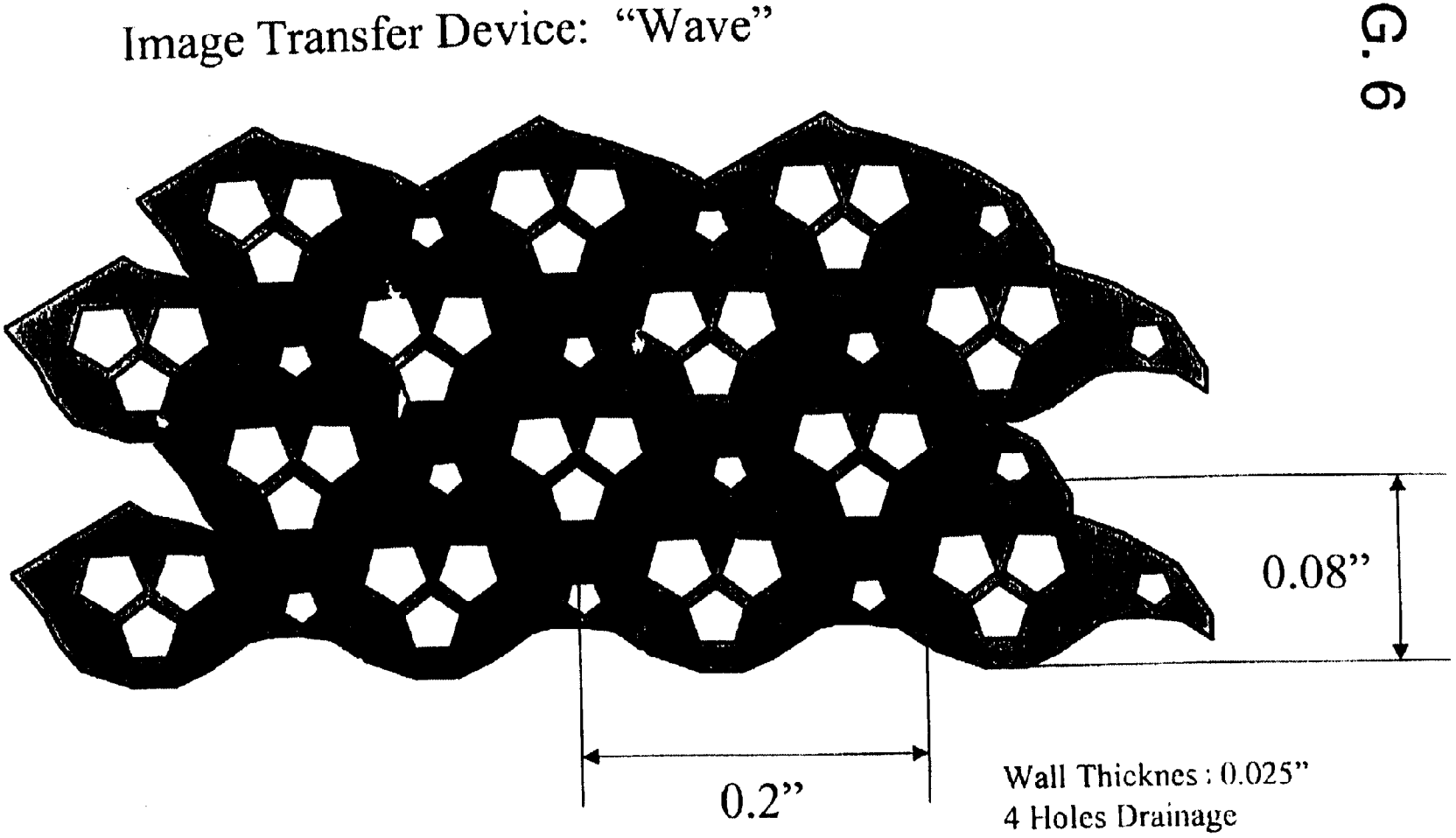
FIGS. 6 is a diagrammatic plan view of the configuration of a "wave" pattern of a three-dimensional image transfer device.
Figure 7:
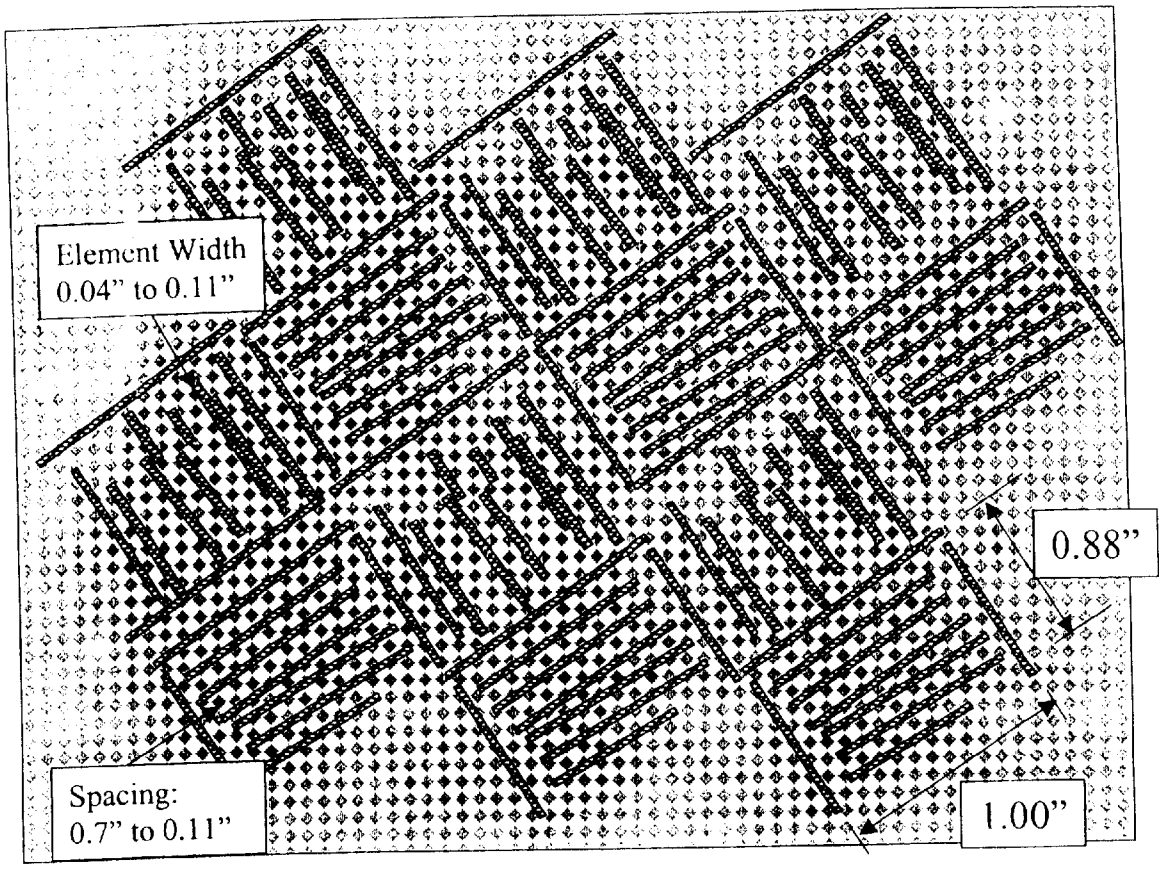
FIG. 7 is a diagrammatic plan view of the configuration of the "enlarged basketweave" pattern of a three-dimensional image transfer device.
Figure 7A:
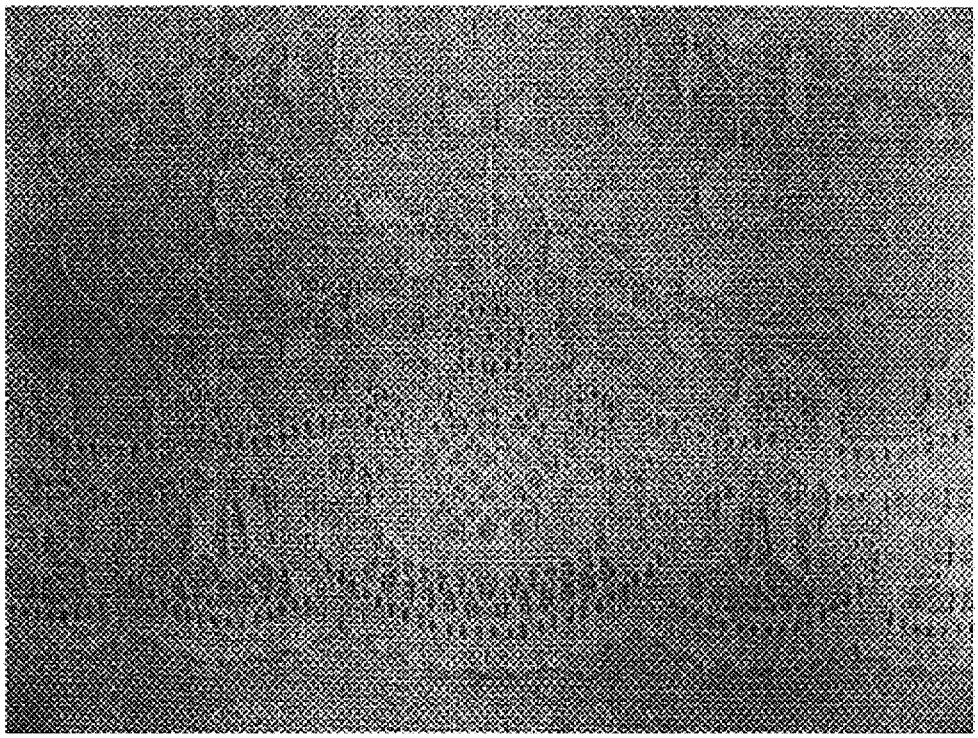
FIG. 7A is a diagrammatic plan view of the configuration of the "placemat" pattern of a three-dimensional image transfer device.
Figure 8A:
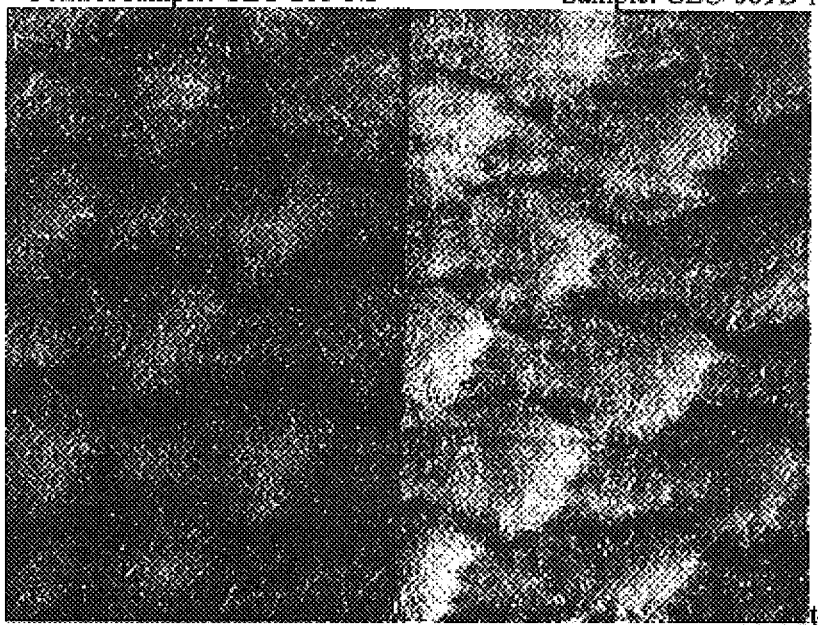
FIGS. 8A to 8F are photomicrographs of nonwoven fabrics including fabrics formed in accordance with the present invention.
Figure 8B:
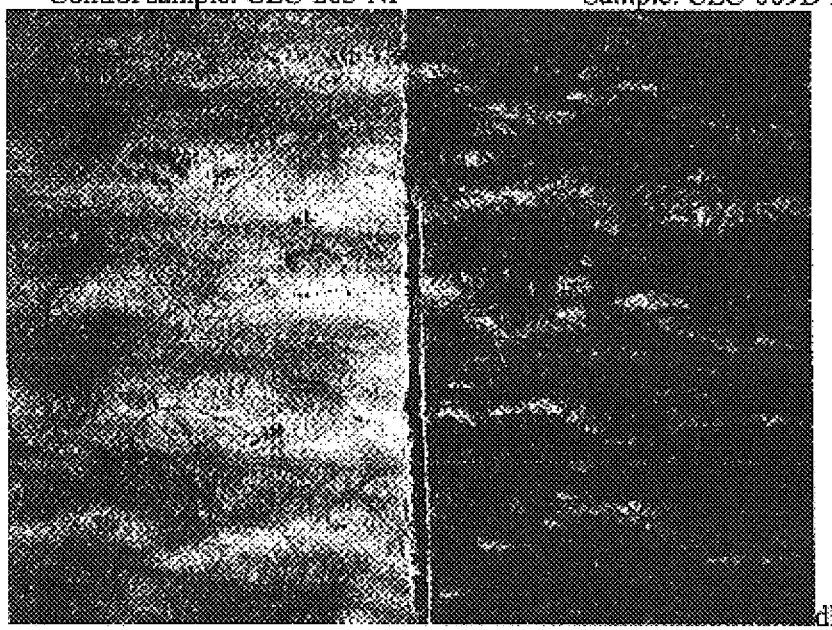
Figure 8C:
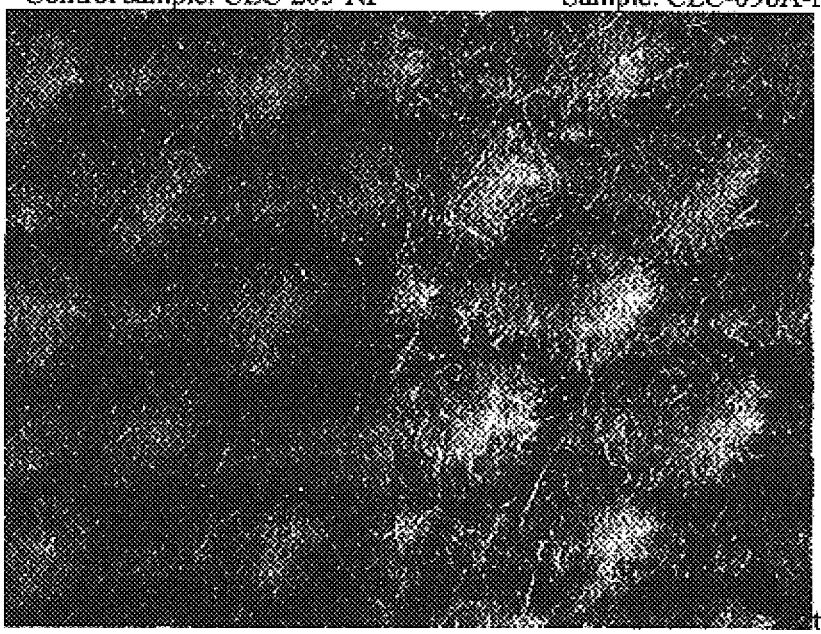
Figure 8D:
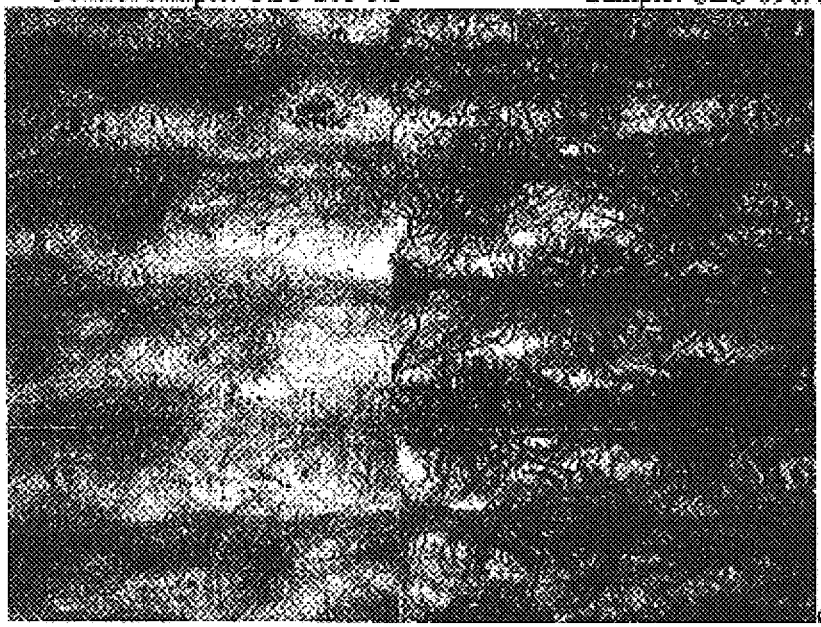
Figure 8E:
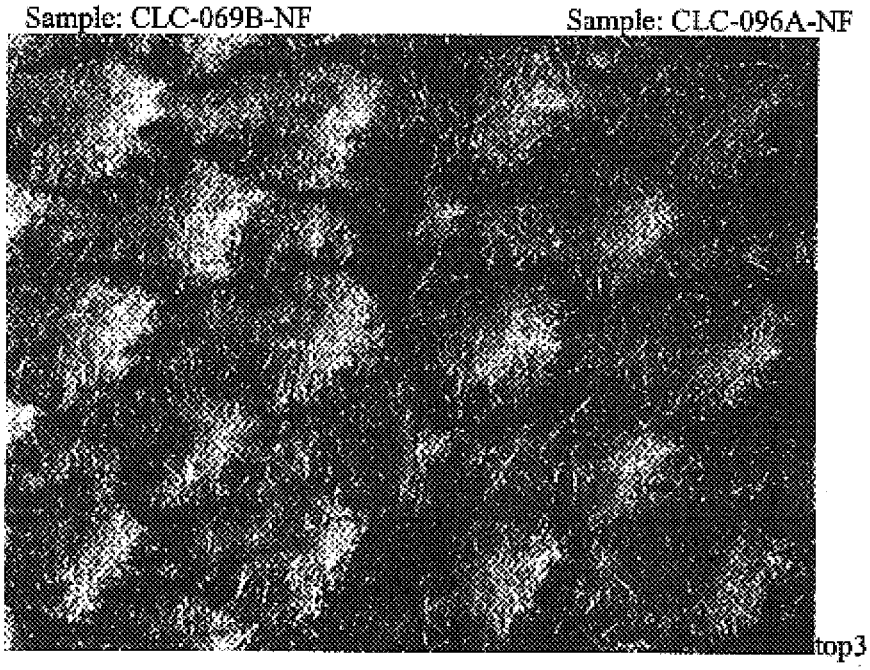
Figure 8F:
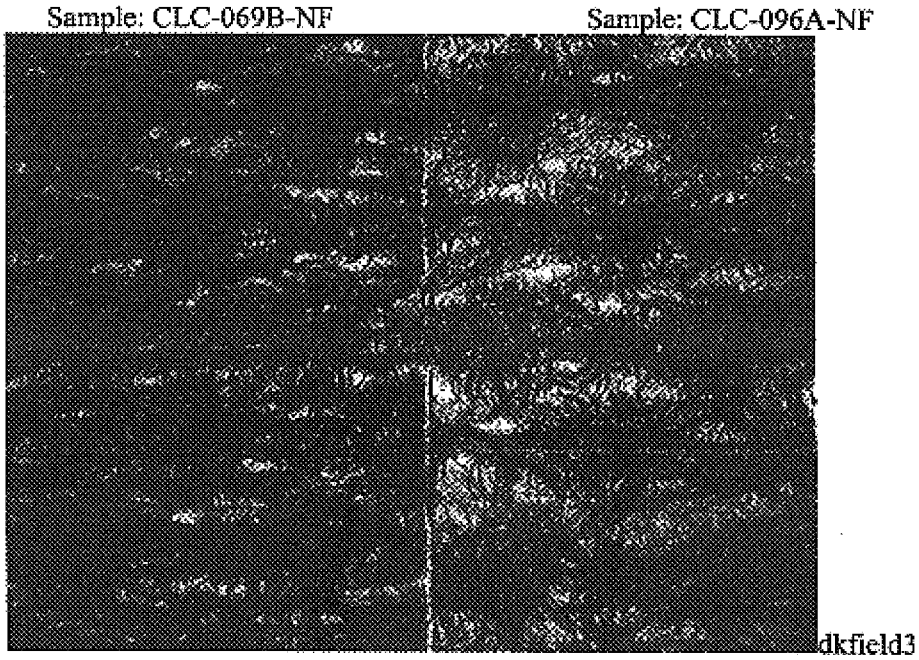

While the present invention is susceptible of embodiment in various forms, there is shown in the drawings, and will hereinafter be described, preferred embodiments of the invention, with the understanding that the present disclosure is to be considered as an exemplification of the invention, and is not intended to limit the invention to the specific embodiment illustrated.

The present invention is directed to a method of forming nonwoven fabrics by hydroentanglement, wherein imaging and patterning of the fabrics is enhanced by hydroentanglement on a three-dimensional image transfer device. Enhanced physical properties of the resultant fabric, including enhanced patterning and imaging, is achieved by providing a precursor web at least partially comprising splittable filaments or fibers, that is, filaments or fibers which can each be divided into plural sub-components. Through the use of high-pressure water jets for effecting hydroentangling and imaging, these splittable fibers or filaments are at least partially separated into their sub-components, with the high pressure water jets acting on these sub-components. By virtue of the reduced bending modules of these relatively fine-denier sub-components, enhanced imaging and patterning of the fabric is achieved. Notably, the drapeability and hand of the resultant fabric is enhanced, thus enhancing versatile use of the fabric.

With reference to FIG. 1, therein is illustrated an apparatus for practicing the present method for forming a nonwoven fabric. The fabric is formed from a precursor web comprising a fibrous matrix which typically comprises staple length fibers, but which may comprise substantially continuous filaments. The fibrous matrix is preferably carded and cross-lapped to form the precursor web, designated P. In accordance with the present invention, the precursor web at least partially comprises splittable staple length fibers or filaments.

FIG. 1 illustrates a hydroentangling apparatus for forming nonwoven fabrics in accordance with the present invention. The apparatus includes a foraminous forming surface in the form of a belt 10 upon which the precursor web P is positioned for pre-entangling by entangling manifold 12. Pre-entangling of the precursor web, prior to imaging and patterning, is subsequently effected by movement of web P sequentially over a drum 14 having a foraminous forming surface, with entangling manifold 16 effecting entanglement of the web. Further entanglement of the web can be effected on the foraminous forming surface of a drum 18 by entanglement manifold 20, with subsequent movement of the web over successive foraminous drums 22 for successive entangling treatment by entangling manifolds 24', 24'.

The entangling apparatus of FIG. 1 further includes an imaging and patterning drum 24 comprising a three-dimensional image transfer device for effecting imaging and patterning of the now-entangled precursor web. The image transfer device includes a movable imaging surface which moves relative to a plurality of entangling manifolds 26 which act in cooperation with three-dimensional elements defined by the imaging surface of the image transfer device to effect imaging and patterning of the fabric being formed.

FIG. 1 also illustrates a J-box or scray 23 which can be employed for supporting the precursor web P as it is advanced onto the image transfer device, to thereby minimize tension within the precursor web. By controlling the rate of the advancement of the precursor web onto the imaging surface to minimize, or substantially eliminate, tension within the web, enhanced hydroentanglement of the precursor web can be effected. Hydroentanglement results in portions of the precursor web being displaced from on top of the three-dimensional surface elements of the imaging surface to form an imaged and patterned nonwoven fabric. By use of relatively high-pressure hydroentangling jets, the splittable fibers or filaments of the precursor web are at least partially separated into sub-components, with enhanced imaging and patterning thus resulting.

The enhanced imaging and patterning achieved through practice of the present invention is evidenced by the appended microphotographs of FIGS. 8A to 8F. The fabric samples designated "CLC-205" were formed from conventional, non-splittable fibers, comprising a 50%/50% blend of polyethylene terephthalate (PET)/nylon fibers. The samples designated "CLC-069B" comprise 100% splittable staple length fibers, having 16 sub-components in a segmented-pie configuration. This type of fiber, available from Fiber Innovation Technology, Inc., under the designation Type 502, comprises a PET/nylon blend, with 8 sub-component segments each of PET and nylon. This type of fiber has a nominal denier of 3.0, with each sub-component having a denier of 0.19. Samples designated "CLC-096" were formed from Unitika splittable staple length fibers, production designation N91, having a denier of 2.5, with 20 sub-components in a segmented-pie configuration, with each sub-component having a 0.12 denier. These splittable fibers also comprise a blend of PET/nylon.

With reference to the microphotographs, it will be observed from the "top light" and "dark field" views that by comparison of the control sample (CLC-205) with sample CLC-069B (F.I.T. splittable fibers), that the splittable fiber sample shows more uniform coverage, with a clearer image, or better image clarity. The dark field comparison shows a much deeper image than that achieved with the control non-splittable fiber sample, with bundling or roping of the entwined sub-denier fiber components being evident. It is believed that the improved image clarity (i.e., less fuzzy pattern) is achieved by virtue of the enhanced fiber entanglement, which is achieved by the relatively reduced bending modules of the sub-components of the splittable fibers.

Comparison of the Unitika splittable fiber sample (CLC-096A) with the control, non-splittable fiber sample also shows improved image clarity, with better definition of the imaged pattern. Interconnecting regions of the pattern, at which less fiber is present, are not as well defined in the control, non-splittable fiber sample, as in the sample formed from splittable fibers in accordance with the present invention. Comparison of the two splittable fiber samples, CLC-069B and CLC-096A, shows the former to provide better defined fiber transition regions, which is believed to be achieved by virtue of this type of fiber being more easily splittable attendant to hydroentangling processing. Very fine sub-denier composite fibers can be hard to make, and can complicate splitting of the fibers, such as by hydroentangling processes. This phenomenon suggests optimum results may be achieved through use of splittable fibers having a certain maximum number of splittable sub-components.

EXAMPLES

Figure 9:
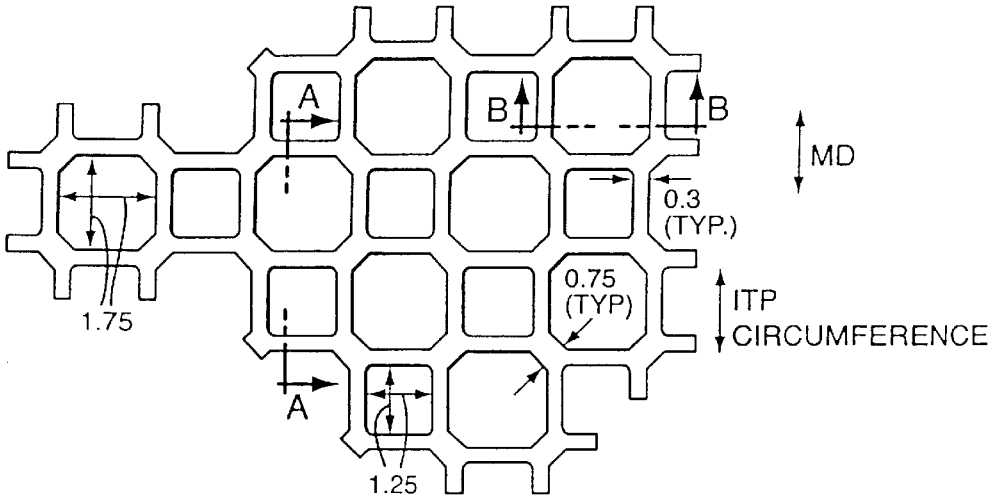
FIG. 9 shows illustrations of a three-dimensional image transfer device having a "octagon and squares" pattern.
Figure 9:
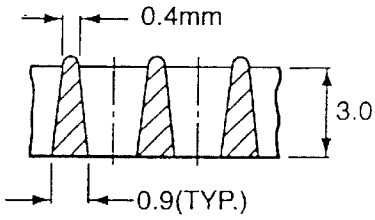
Figure 9:
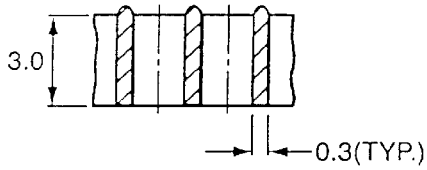
Figure 9:
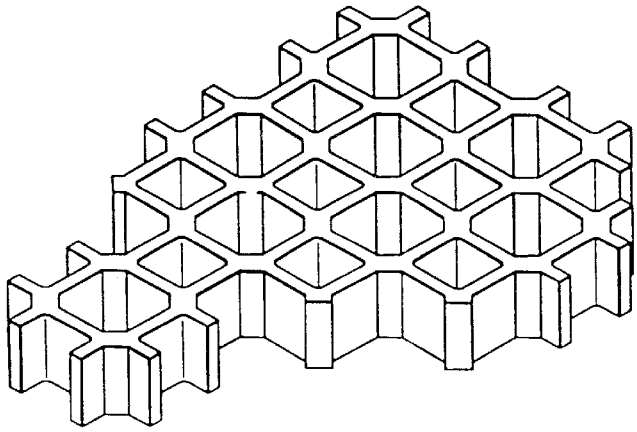

Appended Table 1 (2 pages) sets forth test data regarding various sample nonwoven fabrics formed in accordance with the principles of the present invention, including comparison to control samples. Reference to various image transfer devices (ITD) refers to configurations illustrated in the appended drawings. Reference to "100×98" and "22×23" refers to foraminous forming screens. Reference to "20×20", "12×12", "14×14", and "6×8" refers to a three-dimensional image transfer device having an array of "pyramidal" three-dimensional surface elements, configured generally in accordance with FIG. 9 of U.S. Pat. No. 5,098,764, hereby incorporated by reference. The referenced "placemat" image transfer device is a composite image comprised of a background "tricot" pattern (in accordance with U.S. Pat. No. 5,670,234, hereby incorporated by reference), a central "vine and leaf" pattern, and a circumferential "lace" pattern. The overall dimension of the rectangular image is approximately 10 inches by 13 inches. The approximate depth of the image in the background region is 0.025 inches, and in the "vine and leaf" and "lace" regions is 0.063 inches. Reference to "prebond" refers to a fabric tested after pre-entangling, but formed without imaging on a image transfer device.

For manufacture of the fabric samples, an apparatus as illustrated in FIG. 1 was employed. Pre-entangling manifolds at drums 14, 18, and 22 were operated at 40 bar, 50 bar, 80 bar, and 81 bar, respectively, unless otherwise noted. The three manifolds 26 at the image transfer device 25 were operated at or in excess of 2500 psi, unless otherwise noted.

A further aspect of the present invention contemplates a nonwoven fabric formed from spunbond filaments, wherein each of the filaments comprises plural sub-components which are at least partially separated from each other. Table 2 sets forth certain physical properties of spunbond, as well as staple length, fabrics formed in accordance with the present invention on a foraminous forming surface in the form of a 100 mesh forming screen. As will be observed, fabrics formed in accordance with the present invention from splittable, spunbond filaments, all exhibited very good Taber Abrasion resistance to roping, greater than 35 cycles. In the sample in which the filaments were formed from polyester and polyethylene (8-segment crescent configuration), the fabric exhibited a ratio of machine direction tensile strength to basis weight of 19. For other samples formed from spunbond filaments, comprising polyester and nylon, the ratio of machine direction tensile strength to basis weight was at least about 23. As will be noted, all fabrics formed from spunbond filaments exhibit air permeability no greater than about 26 cfm (ft.$^3$/min.), which can be desirable for certain applications.

Table 2 also shows fabrics formed in accordance with the present invention from splittable fibers. These samples were formed from bicomponent staple fibers comprising polyester and nylon, and exhibited a ratio of machine direction tensile strength to basis weight of at least about 22; these samples all exhibit a Taber Abrasion resistance to roping greater than 35 cycles (i.e., no roping).

Table 2 sets forth comparative data for a representative polyester and pulp fabric (designated PET/pulp). The greater tensile strength, elongation, and Taber Abrasion of fabrics formed in accordance with the present invention will be noted.

From the foregoing, numerous modifications and variations can be effected without departing from the true spirit and scope of the novel concept of the present invention. It is to be understood that no limitation with respect to the specific embodiment disclosed herein is intended or should be inferred. The disclosure is intended to cover, by the appended claims, all such modifications as fall within the scope of the claims.

TABLE 1

| Physical Property | CLC-220-NF | CLC-098A-NF | Delta | CLC-098B-NF | Delta | CLC-098C-NF | Delta |
|---|---|---|---|---|---|---|---|
| Image | 100 × 98 Screen | Wave | 220 v. 098A | Oct/Sq. | 220 v. 098B | 22 × 23 | 220 v. 098C |
| Weight | 2.06 | 2.15 | 4% | 2.08 | 1% | 2.07 | 0% |
| Bulk | 0.014 | 0.021 | 33% | 0.019 | 26% | 0.019 | 26% |
| Tensile - Dry [MD] | 37.5 | 42.7 | 12% | 41.8 | 10% | 42.4 | 12% |
| Tensile - Wet [MD] | 35.2 | 39.8 | 12% | 34.1 | −3% | 45.9 | 23% |
| | −6% | −7% | | −18% | | 8% | |
| Elongation - Dry [MD] | 35.4 | 53.9 | 34% | 40.0 | 11% | 34.3 | −3% |
| Elongation - Wet [MD] | 44.4 | 44.7 | 1% | 41.0 | −8% | 42.3 | −5% |
| | 20% | −17% | | 2% | | 19% | |
| Tensile - Dry [CD] | 23.1 | 20.6 | −11% | 16.9 | −27% | 23.7 | 3% |
| Tensile-Wet [CD] | 16.0 | 18.2 | 12% | 18.4 | 13% | 18.4 | 13% |
| | −31% | −12% | | 8% | | −23% | |
| Elongation - Dry [CD] | 128.6 | 98.8 | −23% | 96.8 | −25% | 93.0 | −28% |
| Elongation - Wet [CD] | 122.8 | 109.3 | −11% | 103.0 | −16% | 87.6 | −29% |
| | −5% | 10% | | 6% | | −6% | |
| Handle [MD] | 37 | 21 | −43% | | | | |
| Handle [CD] | 4 | 3 | −25% | | | | |
| Cantilever Bend [MD] | 7.7 | 7.2 | −6% | | | | |
| Cantilever Bend [CD] | 3.1 | 2.7 | −13% | | | | |
| Absorbency Capacity | 676 | 805 | 16% | 698 | 3% | 716 | 6% |
| Air Perm | 85 | 111 | 23% | 386 | 78% | 407 | 79% |
| Modulus 3% [MD] | 1.03 | 0.68 | −34% | | #DIV/0! | | #DIV/0! |
| Modulus 5% [MD] | 1.17 | 0.78 | −33% | | #DIV/0! | | #DIV/0! |
| Modulus 10% [MD] | 1.14 | 0.83 | −27% | | #DIV/0! | | #DIV/0! |
| Modulus 20% [MD] | 1.03 | 0.9 | −13% | | #DIV/0! | | #DIV/0! |
| Modulus 3% [CD] | 0.05 | 0.015 | −70% | | #DIV/0! | | #DIV/0! |
| Modulus 5% [CD] | 0.05 | 0.015 | −70% | | #DIV/0! | | #DIV/0! |
| Modulus 10% [CD] | 0.05 | 0.02 | −60% | | #DIV/0! | | #DIV/0! |
| Modulus 20% [CD] | 0.05 | 0.025 | −50% | | #DIV/0! | | #DIV/0! |
| Load @ 10% Elong. [MD] | 12.29 | 8.2 | −33% | | #DIV/0! | | #DIV/0! |
| Load @ 10% Elong. [CD] | 0.41 | 0.13 | −68% | | #DIV/0! | | #DIV/0! |
| Load @ 20% Elong. [MD] | 23.01 | 18.3 | −20% | | #DIV/0! | | #DIV/0! |
| Load @ 20% Elong. [CD] | 0.94 | 0.34 | −64% | | #DIV/0! | | #DIV/0! |

| Physical Property | CLC-220-NF | CLC-098A-NF | Delta | CLC-205-NF | CLC-069B-NF | Delta |
|---|---|---|---|---|---|---|
| Image | 100 × 98 Mesh | Wave | 220 v. 098A | Wave | Wave | 205 v. 069B |
| Weight | 2.06 | 2.15 | 4% | 3.1 | 3 | −3% |
| Bulk | 0.014 | 0.021 | 33% | 0.039 | 0.026 | −33% |
| Tensile - Dry [MD] | 37.5 | 42.7 | 12% | 68.3 | 59.1 | −13% |
| Tensile - Wet [MD] | 35.2 | 39.8 | 12% | 66.9 | 59.4 | −11% |
| Delta [Dry v. Wet] | −6% | −7% | | −2% | 1% | |
| Elongation - Dry [MD] | 35.4 | 53.9 | 34% | 64.6 | 44.3 | −31% |
| Elongation - Wet [MD] | 44.4 | 44.7 | 1% | 65.5 | 49.1 | −25% |
| Delta [Dry v. Wet] | 20% | −17% | | 1% | 10% | |
| Tensile - Dry [CD] | 23.1 | 20.6 | −11% | 36.5 | 28.2 | −23% |
| Tensile - Wet [CD] | 16.0 | 18.2 | 12% | 36.2 | 27.5 | −24% |
| Delta [Dry v. Wet] | −31% | −12% | | −1% | −2% | |
| Elongation - Dry [CD] | 128.6 | 98.8 | −23% | 172.2 | 117.8 | −32% |
| Elongation - Wet [CD] | 122.8 | 109.3 | −11% | 149.0 | 118.4 | −21% |
| Delta [Dry v. Wet] | −5% | 10% | | −13% | 1% | |
| Handle [MD] | 37 | 21 | −43% | 35 | 46 | 23% |
| Handle [CD] | 4 | 3 | −25% | 8 | 7 | −13% |
| Cantilever Bend [MD] | 7.7 | 7.2 | −6% | | | #DIV/0! |
| Cantilever Bend [CD] | 3.1 | 2.7 | −13% | | | #DIV/0! |
| Absorbency | 676 | 805 | 16% | | | #DIV/0! |
| Air Perm | 85 | 111 | 23% | | | #DIV/0! |
| Modulus 3% [MD] | 1.03 | 0.68 | −34% | 0.27 | 0.45 | 40% |
| Modulus 5% [MD] | 1.17 | 0.78 | −33 | 0.39 | 0.68 | 43% |
| Modulus 10% [MD] | 1.14 | 0.83 | −27% | 0.54 | 0.9 | 40% |
| Modulus 20% [MD] | 1.03 | 0.9 | −13% | 0.72 | 1.07 | 33% |
| Modulus 3% [CD] | 0.05 | 0.015 | −70% | 0.02 | 0.01 | −50% |
| Modulus 5% [CD] | 0.05 | 0.015 | −70% | 0.02 | 0.01 | −50% |
| Modulus 10% [CD] | 0.05 | 0.02 | −60% | 0.02 | 0.01 | −50% |
| Modulus 20% [CD] | 0.05 | 0.025 | −50% | 0.03 | 0.02 | −33% |
| Load @ 10% Elong. [MD] | 12.29 | 8.2 | −33% | 5.86 | 10.11 | 42% |
| Load @ 10% Elong. [CD] | 0.41 | 0.13 | −68% | 0.12 | 0.4 | 70% |
| Load @ 20% Elong. [MD] | 23.01 | 18.3 | −20% | 15.22 | 22.85 | 33% |
| Load @ 20% Elong. [CD] | 0.94 | 0.34 | −64% | 0.3 | 0.97 | 69% |

TABLE 2

| Sample ID | Shape | Polymer Combination | Fiber Process | Foraminous Surface |
|---|---|---|---|---|
| 2.3 EFP | | PET/Pulp | staple | |
| 91-51-04 | 8-seg crescent | PET/PE | bicomponent spunbond | 100 Mesh |
| 91-51-08 | 8-seg crescent | PET/Nylon | bicomponent spunbond | 100 Mesh |
| 23-12-02 | 16-seg pie | PET/Nylon | bicomponent spunbond | 100 Mesh |
| 23-12-03 | 16-seg pie | PET/Nylon | bicomponent spunbond | 100 Mesh |
| 23-12-04 | 16-seg pie | PET/Nylon | bicomponent spunbond | 100 Mesh |
| CLC-2100 | seg pie | PET/Nylon | bicomponent staple | 100 Mesh |
| CLC-3000 | seg pie | PET/Nylon | bicomponent staple | 100 Mesh |
| CLC-4000 | seg pie | PET/Nylon | bicomponent staple | 100 Mesh |

| | Basis Weight | | Air | MD Grab Tensile | | | MDT/BW | MD Grab |
|---|---|---|---|---|---|---|---|---|
| Sample ID | gsm | oz/yd$^2$ | cfm | g/cm | lb/In | MDT/BW | % of EFP | Elongation % |
| 2.3 EFP | 77.487 | 2.3 | 36 | | 38 | 17 | | |
| 91-51-04 | 96 | 2.85 | 11 | 9659 | 54 | 19 | 112% | 44 |
| 91-51-08 | 113 | 3.35 | 14 | 14469 | 81 | 24 | 142% | 50 |
| 23-12-02 | 76.83 | 2.28 | 22 | 11750 | 66 | 29 | 170% | 44 |
| 23-12-03 | 76.20 | 2.26 | 18 | 10757 | 60 | 27 | 157% | 41 |
| 23-12-04 | 78.32 | 2.32 | 26 | 9624 | 54 | 23 | 136% | 37 |
| CLC-2100 | 76.10 | 2.26 | 34 | 9664 | 54 | 24 | 141% | 45 |
| CLC-3000 | 78.34 | 2.33 | 29 | 10429 | 58 | 25 | 148% | 43 |
| CLC-4000 | 81.52 | 2.42 | 27 | 9576 | 54 | 22 | 130% | 38 |

| | CD Grab | | | CDT/BW | CD Grab Elongation | Energy | Taber Abrasion | | HH |
|---|---|---|---|---|---|---|---|---|---|
| Sample ID | g/cm | lb/in | CDT/BW | % of EFP | % | hp-hr/lb | til roping | til fail | cm |
| 2.3 EFP | | 21 | 9 | | | | 35 | 182 | 24 |
| 91-51-04 | 3247 | 18 | 6 | 71% | 115 | 2.12 | no | 181 | |
| 91-51-08 | 6184 | 35 | 10 | 115% | 100 | 1.8 | no roping | >250 | 32.9 |
| 23-12-02 | 5532 | 31 | 14 | 151% | 99 | 1.14 | no roping | >250 | 33.5 |
| 23-12-03 | 3729 | 21 | 9 | 103% | 82 | 1.86 | no roping | >250 | |
| 23-12-04 | 4470 | 25 | 11 | 120% | 88 | 2.72 | no roping | >250 | |
| CLC-2100 | 4553 | 25 | 11 | 125% | 109 | 1.27 | no roping | 189 | |
| CLC-3000 | 4388 | 25 | 11 | 117% | 102 | 1.81 | no roping | >250 | |
| CLC-4000 | 4147 | 23 | 10 | 107% | 110 | 2.45 | no roping | >250 | 23.3 |

What is claimed is:

1. A method of making a nonwoven fabric, comprising the steps of:

providing a precursor web at least partially comprising splittable, staple length fibers, wherein each of said splittable fibers comprises plural sub-components at least partially separable from each other;

providing a three-dimensional image transfer device having a foraminous forming surface;

positioning said precursor web on said image transfer device, and hydroentangling said precursor web with a plurality of liquid streams to thereby at least partially separate the sub-components of said splittable fibers and impart an image from said image transfer device to said precursor web to form a nonwoven fabric exhibiting a ratio of machine direction tensile strength to basis weight of at least about 22, and a Taber Abrasion resistance to roping greater than 35 cycles.

2. A method of making a nonwoven fabric in accordance with claim 1, further comprising the step of:

jet dyeing said nonwoven fabric.

3. A method of making a nonwoven fabric, comprising the steps of:

providing a precursor web at least partially comprising splittable, staple length fibers, wherein each of said splittable fibers comprises plural sub-components at least partially separable from each other;

providing a three-dimensional image transfer device having a foraminous forming surface;

positioning said precursor web on said image transfer device, and hydroentangling said precursor web with a plurality of liquid streams to thereby at least partially separate the sub-components of said splittable fibers and impart an image from said image transfer device to said precursor web to form a nonwoven fabric, wherein said step of providing set precursor web includes pro ding splittable, staple length fibers wherein the sub-components consist of nylon and one of 1,4 cyclohexamethyl terephthalate and polyethylene terephthalate.

4. A method of making a nonwoven fabric, comprising the steps of:

providing a precursor web at least partially comprising splittable, staple length fibers, wherein each of said splittable fibers comprises plural sub-components at least partially separable from each other;

providing a three-dimensional image transfer device having a foraminous forming surface;

positioning said precursor web on said image transfer device, and hydroentangling said precursor web with a plurality of liquid streams to thereby at least partially separate the sub-components of said splittable fibers and impart an image from said image transfer device to said precursor web to form a nonwoven fabric, wherein said step of providing said precursor web includes providing said web with a blend of said splittable staple length fibers, and fibers selected from the group consisting of nylon, polyester and rayon.

5. A method of making a nonwoven fabric, comprising the steps of:

providing a precursor web at least partially comprising splittable, staple length fibers, wherein each of said splittable fibers comprises plural sub-components at least partially separable from each other;

providing a three-dimensional image transfer device having a foraminous forming surface; and positioning said precursor web on said image transfer device, and hydroentangling said precursor web with a plurality of liquid streams to thereby at least partially separate the sub-components of said splittable fibers and impart an image from said image transfer device to said precursor web to form a nonwoven fabric, further comprising the steps of cross-lapping said precursor w b prior to positioning on said image transfer device.

6. A method of making a nonwoven fabric, comprising the steps of:

providing a precursor web at least partially comprising splittable, staple length fibers, wherein each of said splittable fibers comprises plural sub-components at least partially separable from each other;

providing a three-dimensional image transfer device having a foraminous forming surface;

positioning said precursor web on said image transfer device, d hydroentangling said precursor web with a plurality of liquid streams to thereby at leas partially separate the sub-components of said splittable fibers and impart an image from said image transfer device to said precursor web to form a nonwoven fabric, wherein said step of providing said precursor web includes providing said splittable fibers with a denier of about 2.5 to 3.5, with sub-component of said splittable fibers each having a denier of about 0.1 to 0.3.

* * * * *